US006539571B1

(12) United States Patent
Forsyth

(10) Patent No.: US 6,539,571 B1
(45) Date of Patent: Apr. 1, 2003

(54) SYSTEM FOR CONSTRUCTING LATTICE PANEL BRIDGES

(75) Inventor: Richard Charles Edward Forsyth, Hook (GB)

(73) Assignee: Mabey & Johnson Limited, Berkshire (GB)

( * ) Notice: Subject to any disclaimer, the term of this patent is extended or adjusted under 35 U.S.C. 154(b) by 0 days.

(21) Appl. No.: 09/610,977

(22) Filed: Jul. 6, 2000

(30) Foreign Application Priority Data

Jul. 7, 1999 (GB) ..... 9915957

(51) Int. Cl.[7] ..... E01D 19/00
(52) U.S. Cl. ..... 14/14; 14/4; 14/13; 52/693
(58) Field of Search ..... 14/3, 4, 13, 14; 52/690, 693, 694, 695, 652.1, 654.1, 655.1, 582, 826, 726.1, 726.2, 741.1, 731.7

(56) References Cited

U.S. PATENT DOCUMENTS

| | | | | | |
|---|---|---|---|---|---|
| 3,431,694 | A | * | 3/1969 | Hunnebeck | 52/695 |
| D227,086 | S | * | 6/1973 | Johnson | 52/695 |
| 4,007,507 | A | * | 2/1977 | Hansen | 14/4 |
| 4,151,695 | A | * | 5/1979 | Johnson | 14/14 |
| 4,593,514 | A | * | 6/1986 | Smith | 52/648 |
| 4,706,436 | A | * | 11/1987 | Mabey et al. | 14/4 |
| 4,846,615 | A | * | 7/1989 | Forsyth | 411/355 |
| 4,965,903 | A | * | 10/1990 | Bisch | 14/14 |
| 5,065,467 | A | * | 11/1991 | Forsyth | 14/13 |
| RE34,103 | E | * | 10/1992 | Mabey et al. | 14/4 |

FOREIGN PATENT DOCUMENTS

| | | | | | |
|---|---|---|---|---|---|
| GB | 2019925 | A | * | 4/1979 | E01D/15/12 |
| GB | 2074209 | A | * | 10/1981 | E01D/15/12 |
| GB | 2123461 | A | * | 2/1984 | E01D/15/12 |
| GB | 2251018 | A | * | 4/1991 | E01D/15/12 |

* cited by examiner

*Primary Examiner*—Thomas B. Will
*Assistant Examiner*—Alexandra Pechhold
(74) *Attorney, Agent, or Firm*—Bacon & Thomas, PLLC

(57) ABSTRACT

A system for use in constructing a lattice panel bridge, includes a plurality of substantially rectangular prefabricated steel lattice panels joined in end to end relationship to form a main girder for the bridge. Each panel comprises an upper chord, a lower chord of substantially equal length, a plurality of web members interconnecting the upper and lower chords, and joint forming devices at each end of each chord. The joint forming devices at either end of the lower chord mate and receive a transverse pin for connecting the lower chords of adjacent panels together. The joint forming devices at each end of the upper chord comprises a longitudinally facing plate provided with apertures for receiving fasteners for connecting the plates of adjacent panels together. A spacer is inserted between the plates and this reduces the tendency of the bridge to sag. Optionally the spacers can be used to give the resultant bridge an upwardly facing longitudinal camber.

36 Claims, 6 Drawing Sheets

SYSTEM FOR CONSTRUCTING LATTICE PANEL BRIDGES

FIELD OF THE INVENTION

This invention relates to a system for constructing lattice panel bridges, and is of particular relevance to such bridges of the "Bailey" type.

BACKGROUND TO THE INVENTION

In a typical "Bailey" bridge construction there is provided a main girder at each side of the bridge, transoms extending between the girders and a deck supported on the transoms. The girders are formed from prefabricated lattice panels of steel which are joined together longitudinally. Two or more sets of the lattice panels may be secured together in the vertical direction so as to provide the required depth of girder, and to this end the panels are generally of a rectangular configuration. A common type of lattice panel consists of upper and lower longitudinally extending chords which are joined together by a lattice of web members. These will generally include vertically extending web members and angled web members which may for example extend at an angle of about 45° to the chords. Various panel configurations are disclosed in British Patent Application 2 251 018 and U.S. Pat. No. 5,065,047, for example.

To join the panels together in end to end relationship to provide the required length of girder, pin and aperture joints are usually employed to ensure speed and simplicity of assembly on site. One end of each chord will be formed with a female portion and one with a male portion. These are mated when the panels are to be joined together and then a transverse pin is inserted through apertures in the portions.

Bridges of the above type are often used as temporary structures, for example to replace bridges destroyed by floods, earthquakes or acts of war. They are supplied as prefabricated components which are assembled on site. In one common method of construction, the bridge girders are assembled on one side of the gap to be bridged, such as a river or ravine, and pushed out and over to the other side. Other methods are possible but in general important factors are speed and ease of assembly. Although the bridges are intended primarily for temporary use, they are often capable of long term use and if properly treated against corrosion, such as by galvanising may be capable of lasting for fifty years or more. Given the expense of dealing with other problems arising from natural disasters or acts of war it is desirable if the bridges can be left in place for a significant period to obtain maximum value and to delay as long as possible the expense of a conventional permanent type of structure.

One problem with conventional types of Bailey bridge is that the pin joints use may be subject to misalignment developing. Whilst the joints are stable under tension, under compression there may be a degree of lateral misalignment. The upper chord of a lattice panel will normally be in compression in use, and to compensate for the problem, lateral supporting members may be provided to resist lateral defection of the upper chords.

This problem is addressed in United Kingdom Patent Application 2 251 018, which proposes that the pin joints for the upper chords of a panel should be replaced by plates which are clamped together by longitudinally extending bolts. The specification states that by using abutting plates, lateral flexion at the joints is greatly inhibited. The plate joints may be between reinforcing chords which are attached to conventional upper chords with pin joints, or alternatively a lattice panel may have an upper chord which is provided with the plates instead of the pin joint portions.

There is a tendency for a bridge of the Bailey type to sag, this being caused by a number of factors including vertical flexion of the joints between both upper chords and lower chords. The degree of sag will depend upon many other factors including the span, the depth of the lattice panels and other structural elements used, the physical properties of the various structural elements, the weight of a deck on the bridge, the load to be carried and so forth. Whilst in engineering terms it is acceptable to have a degree of sag, the appearance of a sagging bridge may have a negative effect on users and this may reduce their willingness to tolerate a Bailey bridge as a long term construction. In any event, reduction of excessive sagging may prolong the life of a bridge or reduce the frequency or expense of maintenance work.

The system shown in GB-A-2 251 018 will inevitably reduce vertical flexion in much the same way as it reduces lateral flexion, because the upper chords are joined together by abutting plates clamped together by longitudinal bolts passing through apertures. However, this may not be sufficient to eliminate sag, or reduce it to an acceptable level, due to the influence of the other factors.

SUMMARY OF THE INVENTION

In accordance with the present invention, sagging can be reduced or eliminated by introducing spacers between the plates where the upper chords are joined together so as to impart a tendency towards an upwardly directed camber. The net effect of this and the various sagging effects will be to reduce sagging to a degree that is perceived by users to be acceptable, or to eliminate it, or even to provide a positive upwardly directed camber in the finished bridge.

Joining of the upper chords will be more time consuming than in the case of a conventional pin joint, and in a typical arrangement in accordance with the invention a number of threaded fasteners and the spacer will be required in place of a single pin. This detracts somewhat from one of the aims of a "Bailey" type of bridge construction, namely simplicity of construction. However, the additional time spent is worthwhile since it enables sagging to be reduced or eliminated. Furthermore, the use of plates to form a joint, a spacer and threaded fasteners, for example, reduces costs. Although pin joints are simple to assemble, they require the use of expensive forgings to constitute the male and female portions.

In accordance with the present invention, pin joints are retained for joining together the lower chords of the lattice panels. These will permit two joined panels to pivot with respect to each other in a vertical plane, to account for the spacer positioned between the upper chords, and of course preserve the simplicity of joining together the lower chords.

The upper chords in a "Bailey" type of construction are not always in compression. In some arrangements intermediate supports may be used, upon which the girders will rest. Above these supports the chords will be in tension and pin joints are more appropriate. Accordingly, there may be provided in this region panels whose upper chords have at one end a plate joint and at the other a pin joint. One type of panel could be formed with a plate joint at one end and a male pin joint at the other, and another type could be provided with a plate joint at one end and a female pin joint at the other. These two types could be joined together directly by means of the pin joints, although in preferred arrangements there would be one or more intermediate panels of a conventional type with pin joints at either end of the upper chord.

It will be appreciated that for use in "Bailey" type bridges a system in accordance with the present invention will include a number of panels supplied as prefabricated units together with the spacers and usually component to join the chords together in both the pin type arrangement and the plate type arrangement in accordance with the invention. The panels will normally be substantially rectangular, enabling them to be stacked on top of each other and secured by suitable means to provide in a simple manner a girder of increased depth. Within any bridge, panels of different depths may be combined. The panels will generally be of steel, with the individual elements welded together, although other materials and methods of construction would be possible.

The invention may be viewed from various different aspects, dealing with the system in broad terms, a bridge constructed using the system, a method of constructing such a bridge, and novel lattice panels which may be used optionally in the system if desired.

Viewed from a first aspect the present invention provides a system comprising a plurality of prefabricated components for use in constructing a lattice panel bridge, including a plurality of substantially rectangular prefabricated lattice panels each adapted to be joined in end to end relationship with a plurality of like panels, at least some of said panels comprising an upper chord, a lower chord, a plurality of web members interconnecting the upper and lower chords, and joint forming means at each end of each chord, the joint forming means at either end of the lower chord being adapted to receive a transverse pin for connecting the lower chord to the lower chord of another panel, and the joint forming means at each end of the upper chord comprising a longitudinally facing plate which can be engaged with a corresponding plate of the upper chord of another panel in such a way as to resist vertical displacement between the two panels, characterised in that the system further comprises a plurality of spacers for positioning between the facing plates of the upper chords of two adjacent panels in use, so that the adjacent panels can be angled with respect to each other.

The panels in such a system will be joined in end to end relationship by means of conventional pin joints at the ends of their lower chords and by means of the plates and spacers at the ends of the upper chords. The join between two plates and a spacer must be such as to resist vertical displacement between the two upper chords. This could be provided by a number of arrangements. For example, one plate could be provided with a horizontal protrusion across its width, the other with a matching recess, and the spacer with a recess on one side and a protrusion on the other so that it can fit between the two plates. This form of joint would not resist lateral displacement to a significant degree, other than by virtue of friction between the elements when the joint is under compression. Significant lateral stability could be provided by additional means such as lateral support braces between the upper chord and another bridge component when in use. Preferably, however, the join between two plates, and the spacer, is such as to resist both lateral and vertical displacement. Thus, instead of a horizontal protrusion across its width, one plate could be provided with a rectangular protrusion to engage in a corresponding recess, two sides resisting vertical displacement and two lateral displacement. Another possibility would be to use a circular protrusion.

Preferably however, the join between the plates is formed by means of one or more longitudinally extending fasters passing through apertures in the plates. The fasteners could be pins provided with e.g. split pins or circlips to resist removal, or even rivets. Preferably, they are bolts provided with nuts. The longitudinal fastener should preferably be a reasonably tight fit within the apertures, to resist movement in both the lateral and vertical directions. The joint is not normally required to resist longitudinal tension forces, but an advantage of using bolts and nuts is that the plates and spacer will be clamped together to resist tensile forces if that is necessary.

The number and positions of apertures to take the bolts, or other longitudinal fasteners, can be chosen to give the required degree of stability. In some cases a single central fastener may be sufficient, but preferably there are additionally or alternatively two or more fasteners nearer the edges of the plates to provide enhanced resistance to lateral deflection, and preferably there are vertically spaced fasteners to provide enhanced resistance to vertical deflection. In a typical preferred arrangement, there are two vertically spaced fasteners on one lateral side of the joint, and two on the other, and optionally there may be a central fastener also.

A longitudinal fastener may pass through an aperture in the spacer, or through a recess in the periphery of the spacer, to assist in holding it in place. However, the spacer may be located by other means.

Whilst a system in accordance with the present invention includes panels and spacers which are fastened together, the fasteners themselves whether in the form of bolts and nuts or otherwise do not have to be part of the system in its broadest sense. The system can be supplied to a user without the fasteners, the user obtaining the fasteners separately. Preferably, though, the system is provided to the user with the correct fasteners to avoid problems with inappropriate fasteners being used and compromising the integrity of the structure.

Additional panels may be attached above or below the panels in a conventional manner, and known additional reinforcing chords may be attached to the upper chords of the panels and themselves joined together with the use of plates and fasteners. Reinforcing chords may also in some circumstances be provided for the lower chords.

Although in most circumstances the panels are supplied completely prefabricated with both the upper and lower chords in place, it would be possible to supply the panels in a form disclosed in of the embodiments of GB-A-2 251 018, in which the upper chord for example is supplied as a separate member which has to be attached to the remainder of the panel by the user.

The use of the plates and spacers to join together the upper chords of the panels can reduce or eliminate sagging of a bridge using the panels in the main girders, the spacers effectively increasing the length of the upper chords compared to the lower chords. If desired the spacers can be used to give positive camber to a bridge, i.e. an upwardly curved configuration rather than a level or somewhat sagging configuration.

The thickness of the spacers used will depend amongst other things on the length of a span, the loads to be carried by the bridge, and the desired effect i.e. whether to provide positive camber. The engineer designing the bridge will be able to take into account these and other factors and calculate the amount of spacing required between the plates. A range of standard spacers may be available for the engineer to choose from, for example with thicknesses of say 3, 5 or 10 mm. For the thicker spacers it may be desirable to form them as wedges, to be used with the thickest parts uppermost, if the angular deflection between two adjacent panels is significant. In most applications the deflection between any two adjacent panels will be small, although the overall effect will be significant, and even thickness spacers will be adequate. Where additional reinforcing chords are used, the spacers may be configured to fit between these as well as between the standard upper chords. Preferably, however, separate spacers will be used for the reinforcing chords and the standard upper chords.

The system may incorporate spacers which are positioned between each joint between the upper chords of the panels, or only between selected panels depending upon where it is considered necessary to compensate for sag. The spacers supplied may all be of the same thickness, or of varying thicknesses according to their positions along the bridge. Where panels are to be stacked vertically to provide greater height, the spacers for the upper panels will generally be thicker than those for the lower panels.

In general, the deflection in a traditional Bailey bridge, considered typically at the centre of a span, is due to three contributory factors which are evaluated separately and summated. Firstly the bending deflection is calculated using classic elastic theory with knowledge of the self weight of the structure, the value of the loading to be applied and the relevant geometric and material characteristics of the structure. Secondly, the deflection due to strain in the shear members is calculated with knowledge of the same factors, and is a summation of the effects due to each member. Finally, the movement at the pin positions in the top compression and bottom tension chords allow s a slight rotation of each panel relative to its neighbour. The angle of rotation is a function of the difference in diameter as between the pin and its hole, and of the height of the panel. The deflection of the structure is the summation of the effects of this rotation between each of the panels forming the main girders of the bridge. These three factors are summated to calculate the total deflection.

In accordance with the present invention, the first two factors are calculated in the same way. However, the use of the plate joints between the upper chords substantially resists unwanted relative rotation between the panels. Instead, there is a degree of positive rotation, i.e rotation in the opposite sense to that encountered at pin joints, introduced by the spacers and the effects of this can be summated. The resulting contribution from this factor will not be added to the other two factors, as is the case when analysing conventional Bailey bridge designs, but subtracted from them. By varying the types, number and positions of the spacers the effect of the positively established rotation between the panels can be designed to reduce sagging caused by the other two factors, or to eliminate it, or to provide positive camber of a required amount.

Viewed from a second aspect the present invention provides a method of constructing a lattice panel bridge using a system as described above, in which the lattice panels are joined together in end to end relationship to form main longitudinally extending girders, with spacers positioned between the plates of at least some adjacent upper chords. Viewed from a third aspect the present invention extends to a bridge constructed in accordance with the above method.

Where the system is to be used to construct a bridge with an intermediate support, for example, there may be included different types of panels to handle the transition from compression to tension in the upper chords in the region of the support. Thus, the system may include modified panels which have upper chords which have at one end a longitudinally facing plate provided with at least one aperture for receiving a longitudinally extending threaded fastener for connecting the plate to a similar apertured plate of another panel, and at the other end means adapted to receive a transverse pin for connecting the upper chord to the upper chord of another panel. The system may also include standard panels with means for forming pin joints at the ends of both the upper and lower chords, as well as reinforcing chords for attachment to the upper chords of the panels.

Viewed from a fourth aspect, therefore, the present invention provides a substantially rectangular prefabricated lattice panel for use in constructing a main girder for a lattice panel bridge by being joined in end to end relationship with similar panels, the panel comprising an upper chord, a lower chord, a plurality of web members interconnecting the upper and lower chords, and joint forming means at each end of each chord, the joint forming means at either end of the lower chord being adapted to receive a transverse pin for connecting the lower chord to the lower chord of another panel, and the joint forming means at one end of the upper chord comprising a longitudinally facing plate for connection to a plate of the upper chord of another panel, in such a way as to resist vertical displacement between the two panels, characterised in that the joint forming means at the other end of the upper chord comprises means adapted to receive a transverse pin for connecting the upper chord to the upper chord of another panel.

In one form, the panel has a female pin joint forming portion at said other end of the upper chord, and in another form a male pin joint forming portion. The panel may be joined by means of the plate to a like panel, to a panel with the opposite gender of pin joint forming portion at its other end, or to a panel as described earlier with a plate at either end of the upper chord. A spacer may or may not be provided between the plates, as desired.

The prefabricated panels used in the various aspects of the present invention will generally be of steel, with the component parts welded or otherwise permanently joined together. The components may be galvanised or otherwise treated to resist corrosion. The pins used will generally be of high tensile steel, and the fasteners may be in the form of high tensile bolts provided with nuts and suitable ancillary items such as washers, locking spring washers and so forth. In one preferred form a female type of pin joint portion comprises a pair of spaced members with aligned transverse apertures. A male type of pin joint portion preferably comprises an apertured spigot which is inserted into the female part of the lower chord of another panel, with the apertures in alignment so that a pin can be passed through them to form the joint. Suitable means such as split pins or circlips can be used to prevent axial dislodgement of the pin.

It will be appreciated that expressions such as "upper" and "lower" and the like used in relation to the panels refer to the intended orientation in normal use in a simple span bridge, and not to any particular orientation during manufacture, storage or transportation. Furthermore, the expression "bridge" is to be construed broadly to cover structures which might normally be referred to as "flyovers" or the like.

BRIEF DESCRIPTION OF THE DRAWINGS

Some embodiments of the invention will now be described by way of example and with reference to the accompanying drawings in which.

DETAILED DESCRIPTION OF THE PREFERRED EMBODIMENTS

Figure 1:
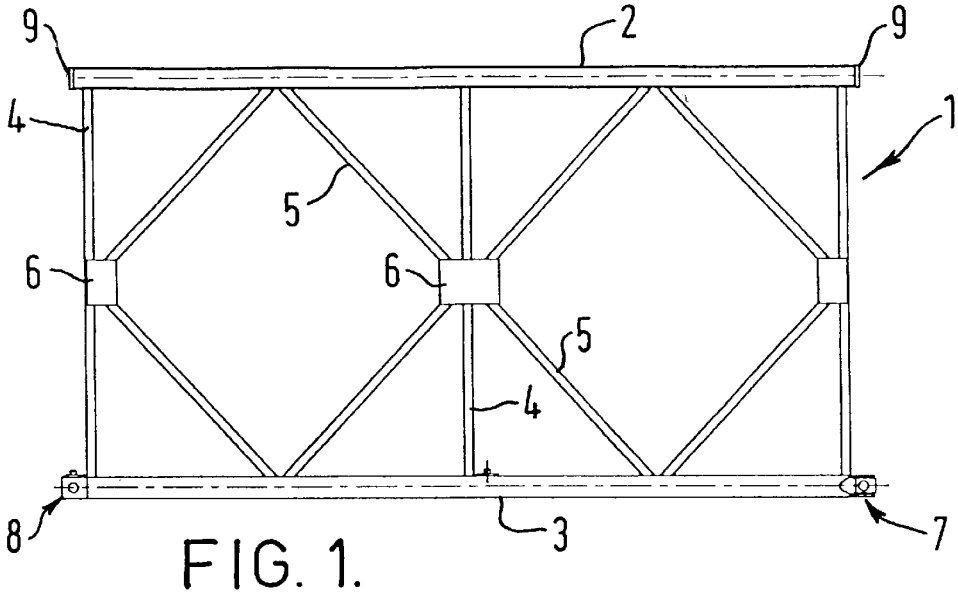
FIG. 1 is a perspective view of a lattice panel for use in a system in accordance with the present invention.

Turning now in detail to the figures, in the figures there is shown a lattice panel 1 for use in a lattice panel bridge of the Bailey type, where it will be joined end to end with similar panels to form a main longitudinal girder. The panel consists of a number of steel components which have been welded together and is of the same general construction as the panel described and illustrated with reference to FIGS. 9*a* to 9*d* in GB-A-2 251 018. The panel comprises an upper chord 2 and a lower chord 3. The panel is of rectangular shape and the upper and lower chords are of substantially the same length. Each of the chords consists of a pair of spaced apart chord members 2*a,* 2*b* and 3*a,* 3*b* defined by channel members (see FIGS. 2 and 4). Between these extend vertical web members 4, perpendicular to the chords, and angled web members 5 at 45° to the chords, although other angles may be used such as 35° to 55°. Strengthening gussets 6 are provided. The web members are received within the gaps between the chord members 2*a,* 2*b* and 3*a,* 3*b*. Between the spaced apart upper chord members 2*a,* 2*b,* are provided apertured portions (not shown) which enable the panel to be attached by bolts to another panel vertically above it if desired, or to enable a reinforcing chord to be attached as described later. Between the spaced apart lower chord members 3*a,* 3*b,* are provided apertured portions (not shown) which enable the panel to be attached by bolts to another panel vertically below it if desired, or to a reinforcing member.

Figure 2:
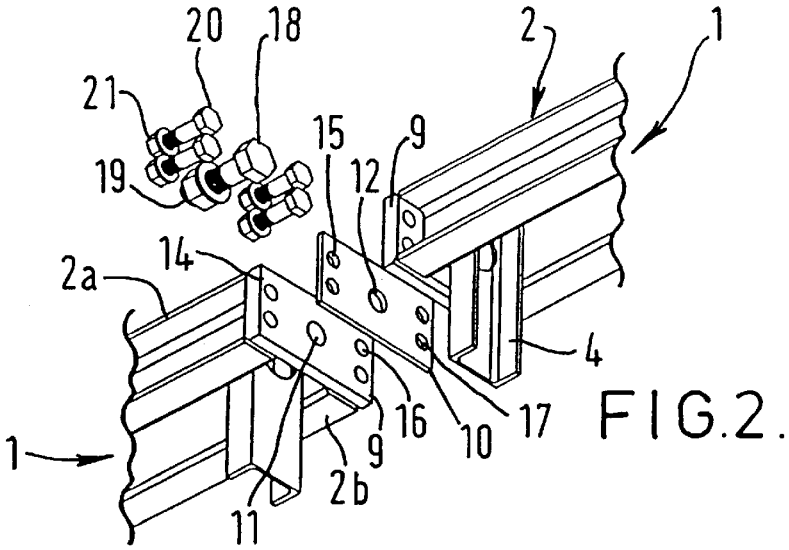
FIG. 2 is a an exploded partial view showing the mechanism for joining together the upper chords of two panels.
Figure 3:
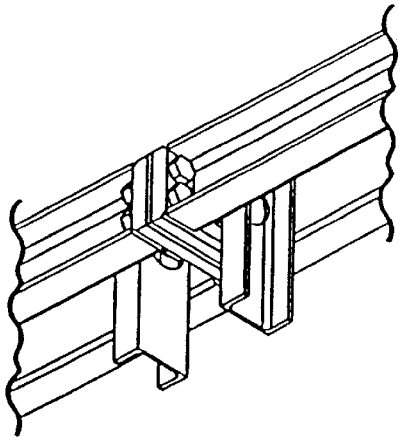
FIG. 3 is a view corresponding to FIG. 2, showing the panels joined together.

At the right hand end of the lower chord 3 is provided the female part 7 of a pin joint, and at the left hand end of the lower chord is provided the male part 8 of a pin joint which is adapted to mate with the female part of the lower chord of a like member. The construction of these will be described in more detail below with reference to FIGS. 4 and 5. At the ends of the upper chord 2, in place of the pin connection portions there are provided matching longitudinally facing plates 9 which are illustrated in greater detail in FIGS. 2 and 3. To construct a girder for a bridge, a number of panels 1 are joined together in end to end relationship, two joined panels being shown in FIG. 6. The lower chords 3 are joined together in a conventional manner by means of the male and female pin joint portions 7,8. However, in accordance with the invention the upper chords are joined together by means of the plates 9, with an intervening spacer 10 as shown in FIGS. 2 and 3. This imparts a degree of relative rotation of two joined panels about the axis of the pin joint between the lower chords.

As shown in FIGS. 2 and 3, the plates are welded to the ends of upper chord members 2*a,* 2*b*. Each plate 9 and each intervening spacer 10, which in this case are of matching rectangular shape, is provided with a central aperture (11, 12), two vertically spaced apertures (14, 15) on one side and two vertically spaced apertures (16,17) on the other side. A large central bolt 18 is provided, together with a matching nut 19, together with four bolts 20 and matching nuts 21. Ancillary items such as washers may be provided as necessary. In use, the upper chords are joined by bolting together the plates 9, with the intervening spacer 10, by means of the bolts and nuts as shown in FIG. 3. This provides a secure connection which is better able than a pin joint to cope with compressive stresses during use.

Figure 4:
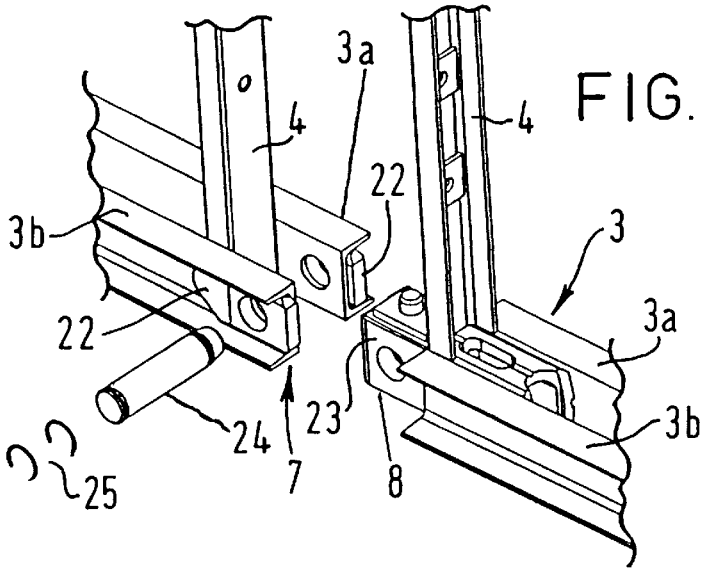
FIG. 4 is an exploded partial view showing the mechanism for joining together the lower chords of two panels.
Figure 5:
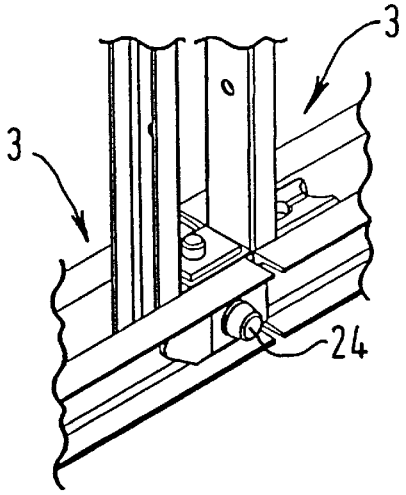
FIG. 5 is a view corresponding to FIG. 4, showing the panels joined together.

As shown in FIGS. 4 and 5, the pin joint between the lower chords of two panels is of a conventional types. The female part 7 comprises a pair of apertured forgings 22 welded to the lower chord members 3*a,* 3*b,* which are also apertured. The male part 8 comprises an apertured spigot 23 which is welded between the lower chord members 3*a,* 3*b*. The spigot 23 is inserted into the female part 7, and a transverse pin 24 is used to hold the lower chords together, the pin being retained by circlips 25. The finished joint is as shown in FIG. 5.

Figure 6:
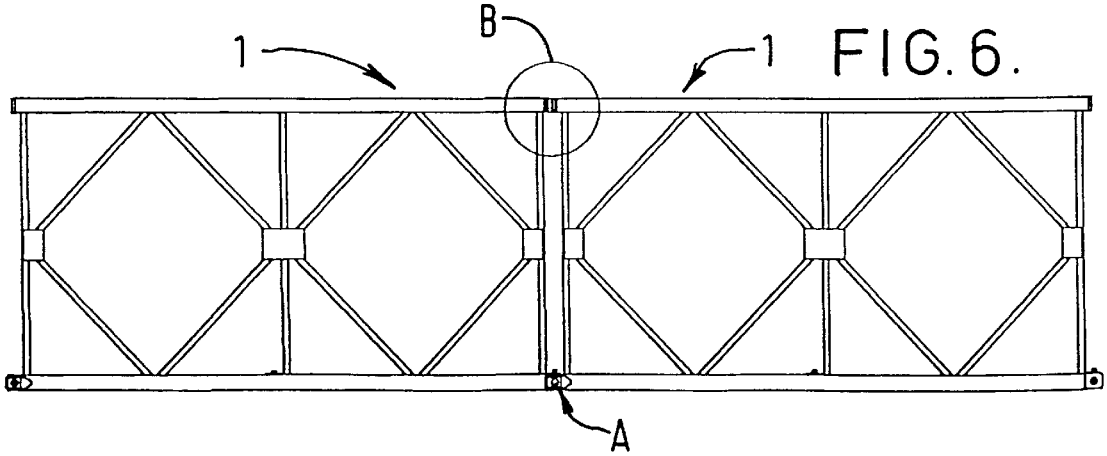
FIG. 6 is a side view of two of the panels joined together.
Figure 7:
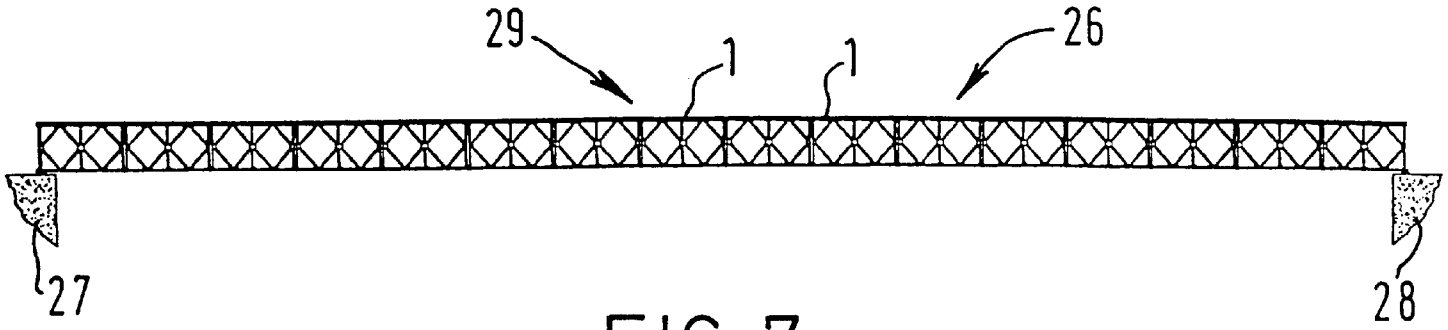
FIG. 7 is a side view of a bridge using the panels.
Figure 9:
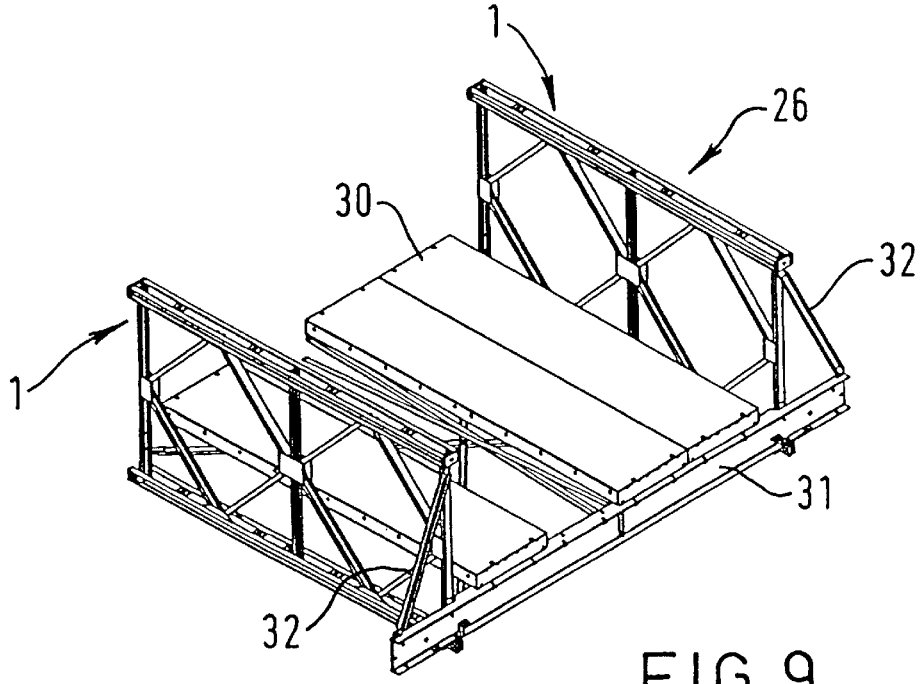
FIG. 9 is a perspective view of part of the bridge of FIG. 7 or FIG. 8.

FIG. 6 shows two panels 1 joined together in the manner described above, with the pin joint between the lower chords indicated at 'A' and the plate joint, corresponding to FIG. 3, at 'B'. In use a number of the panels are joined end to end to form a main girder for a bridge. FIGS. 7 and 9 show a simple bridge 26 of the Bailey type bridging a gap between two points 27 and 28. The bridge comprises a pair of laterally spaced main girders 29 each of which consists of a number of lattice panels 1 which have been joined together end to end in the manner described above. A deck 30 has been laid on the girders, with transverse support members 31 being used also. In this configuration the upper chords 2 are in compression and the lower chords 3 in tension. In this embodiment the bridge the bridge has been designed to remain level, without sagging, as a result of the plate joints with spacers used between the upper chords in place of the conventional pin joints. In this example, optional transverse support struts 32 are used to provide additional lateral support.

The same thickness of packing plate may be used throughout, or packing plates of differing thickness. For some joints packing plates may be omitted. For typical bridges with rectangular panels of dimensions of say about 3 m×1.5 m or 3 m×2 m, packing plates of 3 to 10 mm may be used for normal spans and loads. For thicker packing plates and greater deflections between adjacent panels it may be necessary to use wedge shaped packing plates, whose faces will be angled to match the degree of rotation between the joined panels.

Figure 8:
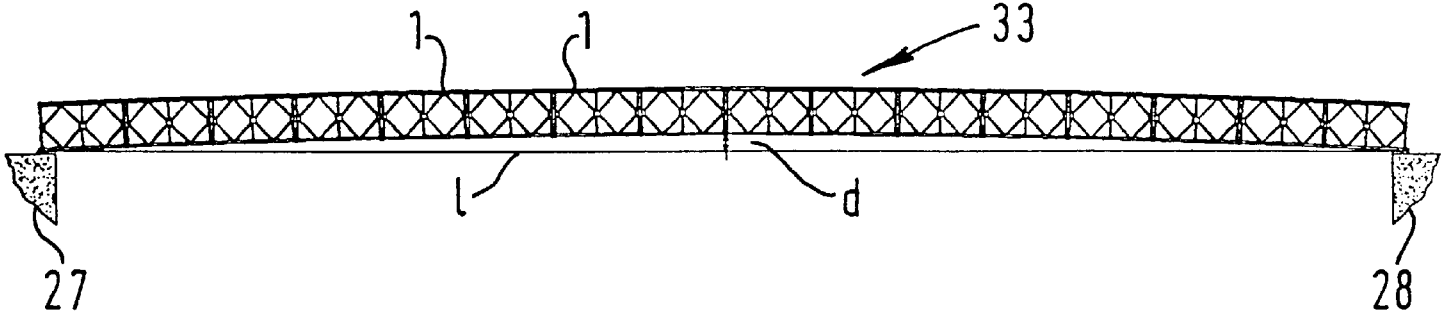
FIG. 8 is a side view of a bridge using the panels, in which there is positive camber.

FIG. 8 shows a bridge 33 which is a modification of the bridge of FIGS. 7 and 9. Whilst its general construction is identical, thicker spacers have been employed. In this case the bridge has been designed to have a degree of positive camber, the centre of the span being raised by a distance 'd' relative to the base line 'l'.

Figure 10:
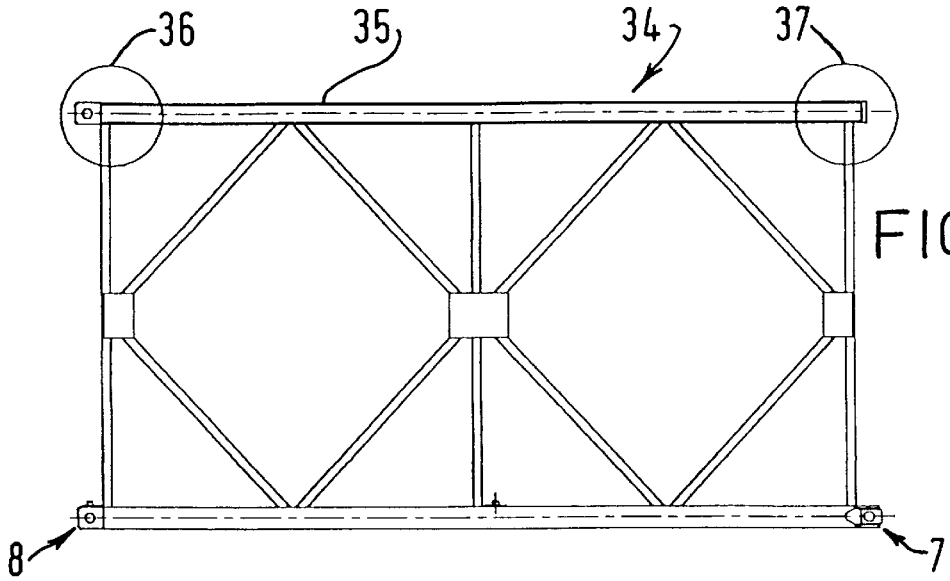
FIG. 10 is a side view of a panel having a hybrid upper chord with a male pin connector at one end.
Figure 11:
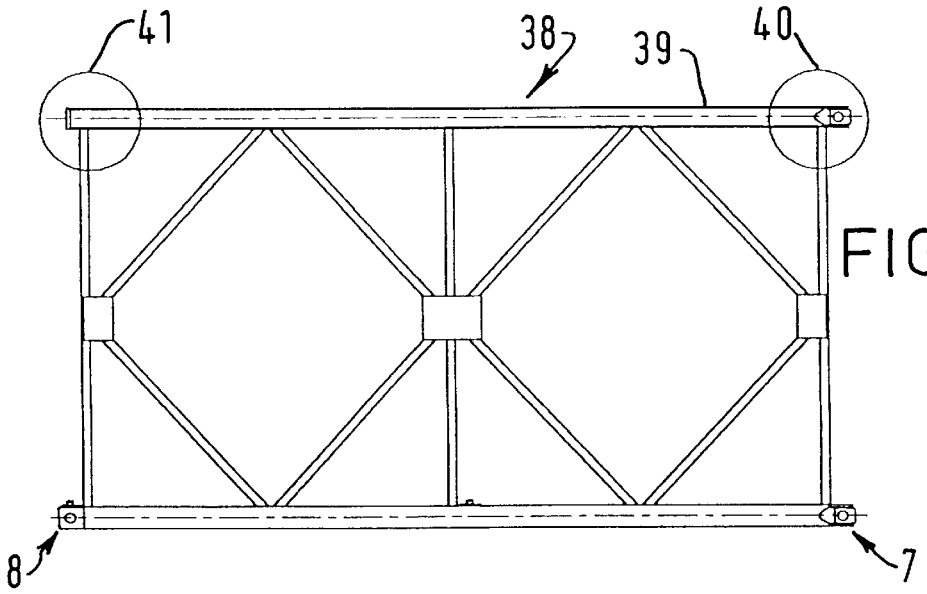
FIG. 11 is a side view of a panel having a hybrid upper chord with a female pin connector at one end.
Figure 12:
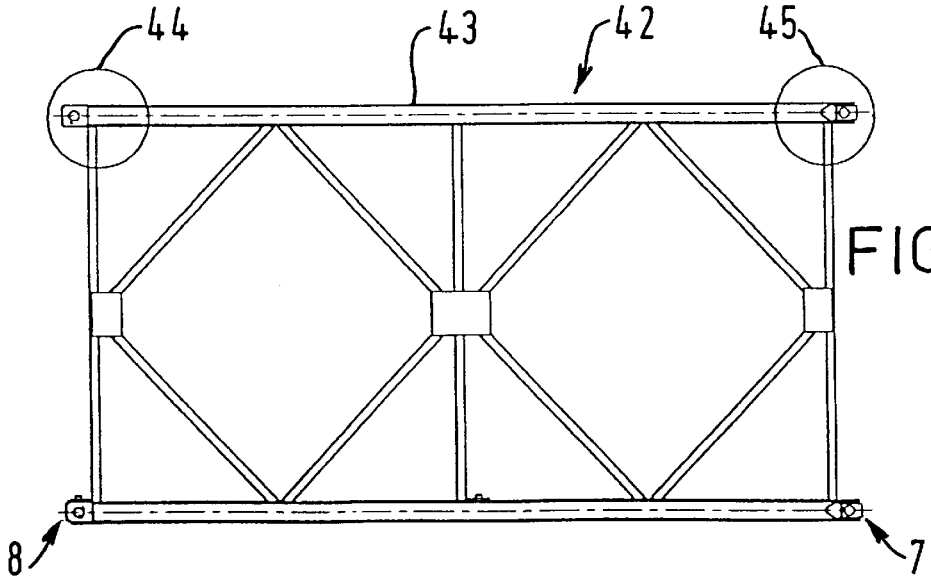
FIG. 12 is a side view of a conventional panel which can be used in the system with pin connections for all four joints.

FIG. 10 shows an alternative panel 34 which is identical to panel 1 except as regards the joint at the left hand side of upper chord 35 where the plate has been replaced by the male part 36 of a pin joint, having a configuration corresponding to that shown in FIG. 4. The right hand end 37 of the upper chord has the same configuration as shown in FIG. 2. FIG. 11 shows an alternative panel 38 which is identical to panel 1 except as regards the joint at the right hand side of upper chord 39 where the plate has been replaced by the female part 40 of a pin joint, also having a configuration corresponding to that shown in FIG. 4. The left hand end 41 of the upper chord has the same configuration as shown in FIG. 2. It will thus be seen that panels 34 and 38 could be joined together with a pin joint between the upper chords rather than the plate joint, in circumstances where the joint might be under tension rather than compression, for example above a support column or the like. In practice, panels 34 and 38 would not normally be joined together directly but by means of an intermediate panel of a conventional type with pin joint portions at either end of the upper chord. Such a conventional panel is shown in FIG. 12. This shows a panel 42 which is identical to panel 1 except as regards the joints at the left and right hand sides of upper chord 43. This panel has the male part 44 of a pin joint at the left hand side of the upper chord 43, and the female part 45 of a pin joint at the right had side of the upper chord 43. In each case the pin joint parts correspond to the construction shown in FIG. 4.

Thus where there is a supporting column there may be a transition from a plate joint to a pin joint for the upper chords, using panel 34, then pin joints using panel 42, and then a transition back to plate joints using panel 38.

Figure 13:
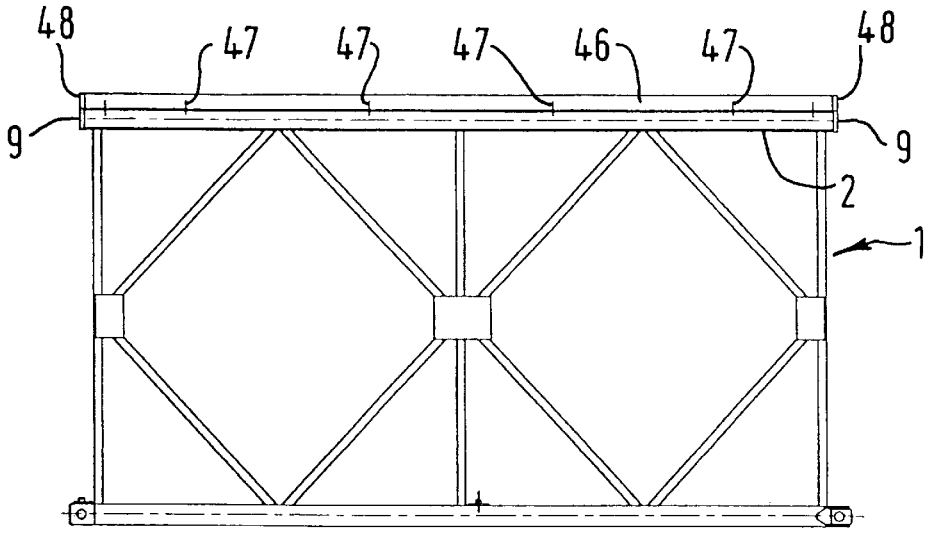
FIG. 13 is a side view of a panel as shown in FIG. 2 with a reinforcing chord attached.
Figure 15:
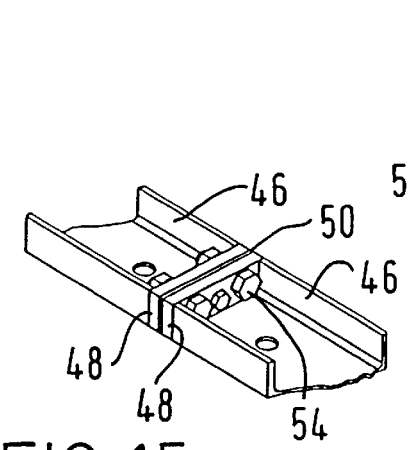
FIG. 15 is a view corresponding to FIG. 14, showing the reinforcing chords joined together.
Figure 14:
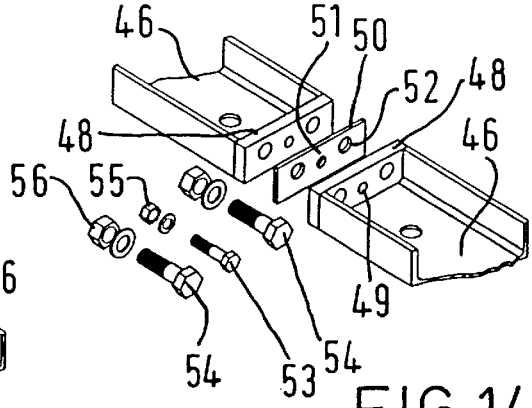
FIG. 14 is an exploded partial view showing the mechanism for joining together two reinforcing chords; of FIG. 11.
Figure 16:
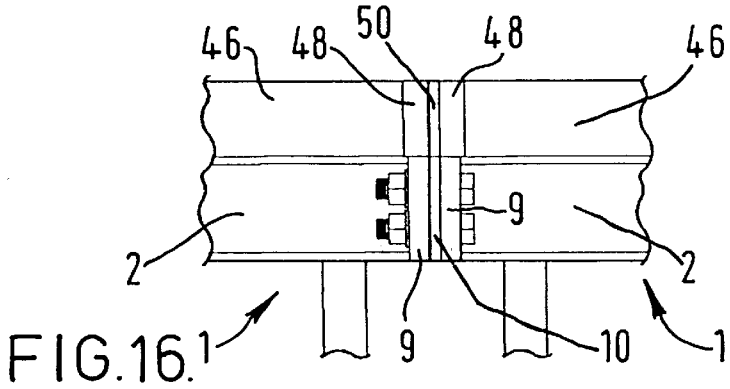
FIG. 16 is a partial side view showing two panels and reinforcing chords joined together.

FIG. 13 shows a panel 1 as described above with a reinforcing chord 46, in the form of a channel member, attached to the upper chord 2 to assist in resisting compressive stresses. The reinforcing chord 46 is attached to upper chord 2 by means of bolts passing through apertured portions as indicated diagrammatically at 47. At each end of the reinforcing chord 46 is provided an end plate 48 welded to the channel member, which is arranged to be flush with the adjacent plate 12 of the upper chord of the panel. As shown in FIG. 14, each end plate 48 of the reinforcing chord is provided with a small central aperture 49 and two side apertures. A rectangular spacer 50 matching the end plates 48 is also provided with matching apertures 51 and 52. Bolts 53 and 54, with appropriate nuts 55 and 56 and ancillary items such as washers if desired, are used to bolt together the end plates 48 with the intervening spacer 50 as shown in FIG. 15. FIG. 16 shows how both the reinforcing chords 46 and the upper chords 2 of two panels 1 are bolted together with their respective spacers 50 and 10. This is preferred to using a single spacer to span the plates of the upper chords and the reinforcing chords, although there might be cases where that would be possible.

Figure 17:
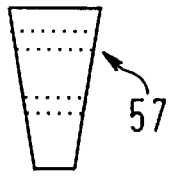
FIG. 17 is a side view of a spacer.

Finally, FIG. 17 shows a side view of a relatively thick spacer 57 which is of wedge configuration, the faces of the spacer being inclined so as to match the angle between two joined panels 1. Such a spacer may be used between the plates of upper panel chords or of reinforcing chords, the dimensions and apertures being chosen as appropriate.

In a two storey arrangement, in which panels are joined in the vertical direction, adjacent panels in the lower storey will use a spacer of a first thickness, t between the upper chords. In the upper storey, the upper chords will be joined via a thicker spacer. If the panels are of the same height in the two storeys then this will have a thickness of 2 t. If there are different heights then the ratio between the thicknesses will vary accordingly. In the upper storey, the lower chords of the panels cannot be joined together in the conventional manner, whether they are pin joints or in some other form. Spacers could be used, or the chords not joined together directly, for example. The lower chords of the upper panels would already be joined to the upper chords of panels in the lower storey, and those chords are of course already joined together.

By means of the various aspects of the invention and the specific components specified above, it is possible to construct lattice panel bridges of the Bailey type with reduced or no unwanted sagging, or if desired with reverse camber so that it rises in the middle and falls away towards the end. The advantages of using rectangular prefabricated panels are maintained and the improvement achieved with a minimum of additional complexity. The lower chords are joined directly to each other by the pin joints, without the need for intermediate members, and the modifications concern the upper chord joints.

The invention is not limited to the specific embodiments described. It will be appreciated that many variations may be possible within the spirit and scope of the accompanying claims whilst still retaining the advantages of the broad aspects and specific components described above.

What is claimed is:

1. A lattice panel bridge section comprising:

a plurality of lattice panels joined in an end to end relationship, each lattice panel having a longitudinally extending upper chord, a longitudinally extending lower chord and a plurality of web members interconnecting the upper and lower chords;

the lower chords of adjacent panels joined by pivot joints each formed by a transverse pin having an axis and passing through axially aligned transverse apertures defined on the respective lower chords;

the upper chords of adjacent panels having longitudinally facing plates connecting said upper chords together; and a spacer positioned between the adjacent longitudinally facing plates on the upper chords of adjacent panels, the spacer biassing the adjacent panels apart with respect to each other to an angle about the axis of the transverse pin.

2. The lattice panel bridge section as claimed in claim 1, wherein the bias to an angle between adjacent lattice panels is arranged to provide resistance to sagging of the lattice panel bridge section.

3. The lattice panel bridge section as claimed in claim 1, wherein said bias to an angle between adjacent lattice panels is arranged to urge an upwards camber in the lattice panel bridge section.

4. A lattice panel bridge incorporating a lattice panel bridge section as claimed in claim 1.

5. A lattice panel bridge section comprising:

a first lattice panel having a longitudinally extending upper chord, a longitudinally extending lower chord, and a plurality of web members interconnecting the upper and lower chords, the first lattice panel having a first end and a second end;

a second lattice panel having a longitudinally extending upper chord, a longitudinally extending lower chord, and a plurality of web members interconnecting the upper and lower chords, the second lattice panel having a first end and a second end;

the first end of the first lattice panel connecting to the first end of the second lattice panel by means of a pin joint formed by a transverse pin passing axially through aligned transverse apertures defined on the lower chord of the first lattice panel and the lower chord of the second lattice panel;

the first end of the first lattice panel connecting to the first end of the second lattice panel by means of a plate joint formed by a longitudinally facing plate disposed on the upper chord of the first lattice panel and a longitudinally facing plate disposed on the upper chord of the second lattice panel, the plate joint resisting vertical displacement between the upper chords of the first and second lattice panels;

a spacer positioned between the longitudinally facing plates of the plate joint and imparts a tendency towards an upwardly directed camber in the lattice panel bridge section;

at the second end of the first lattice panel said lower chord being provided with a pin joint portion having a transverse aperture and said upper chord being provided with a plate joint portion having a longitudinally facing plate; and at the second end of the second lattice panel said lower chord being provided with a pin joint portion having a transverse aperture and said upper chord being provided with a plate joint portion having a longitudinally facing plate.

6. The lattice panel bridge section as claimed in claim 5, including a third lattice panel having a longitudinally extending upper chord, a longitudinally extending lower chord, and a plurality of web members interconnecting the upper and lower chords, the third lattice panel having a first end and a second end wherein:

the first end of the third lattice panel is connected to the second end of the first lattice panel by means of a pin joint formed by a transverse pin passing axially through a transverse aperture provided in the lower chord of the third lattice panel which is aligned with the transverse aperture in the pin joint portion of the lower chord at the second end of the first lattice panel;

the first end of the third lattice panel is connected to the second end of the first lattice panel by means of a plate joint formed by a longitudinally facing plate of the plate joint portion on the upper chord of the third lattice panel and the longitudinally facing plate of the plate joint portion on the upper chord at the second end of the first lattice panel; and at the second end of the third lattice panel said lower chord is provided with a pin joint portion having a transverse aperture and the upper chord is provided with a pin joint portion having a transverse aperture.

7. The lattice panel bridge section as claimed in claim 6, including a fourth lattice panel having a longitudinally extending upper chord, a longitudinally extending lower chord, and a plurality of web members interconnecting the upper and lower chords, the fourth lattice panel having a first end and a second end, wherein:

the first end of the fourth lattice panel is connected to the second end of the third lattice panel by means of a pin joint formed by a transverse pin passing axially through a transverse aperture provided in the lower chord of the fourth lattice panel which is aligned with the transverse aperture in the lower chord at the second end of the third lattice panel;

the first end of the fourth lattice panel is connected to the second end of the third lattice panel by means of a pin joint formed by a transverse pin passing axially through a transverse aperture provided in the upper chord of the fourth lattice panel which is aligned with the transverse aperture in the upper chord at the second end of the third lattice panel; and at the second end of the fourth lattice panel said lower chord is provided with a pin joint portion having a transverse aperture and the upper chord is provided with a pin joint portion having a transverse aperture.

8. The lattice panel bridge section as claimed in claim 7, wherein:

the first end of the lower chord of the first lattice panel, the first end of the lower chord of the third lattice panel, the first end of the lower chord of the fourth lattice panel and the first end of the upper chord of the fourth lattice panel are each provided with two laterally spaced portions with axially aligned lateral apertures, forming a female pin joint portion of the respective pin joint; and the first end of the lower chord of the second lattice panel, the second end of the lower chord of the first lattice panel, the second end of the lower chord of the third lattice panel and the second end of the upper chord of the third lattice panel are each provided with a spigot with a lateral aperture, the spigot forming a male pin joint portion of the respective pin joint.

9. The lattice panel bridge section as claimed in claim 8, wherein the second end of the upper chord of the fourth lattice panel and the second end of the lower chord of the fourth lattice panel are each provided with a pin joint portion in the form of a spigot having a lateral aperture.

10. The lattice panel bridge section as claimed in claim 8 wherein the second end of the lower chord of the second lattice panel is provided with a pin joint portion having two laterally spaced portions with axially aligned lateral apertures.

11. The lattice panel bridge section as claimed in claim 7 wherein:

the first end of the lower chord of the first lattice panel, the first end of the lower chord of the third lattice panel, the first end of the lower chord of the fourth lattice panel and the first end of the upper chord of the fourth lattice panel are each provided with a spigot portion with a lateral aperture, the spigot portion forming a male part of the respective pin joint; and the first end of the lower chord of the second lattice panel, the second end of the lower chord of the first lattice panel, the second end of the lower chord of the third lattice panel and the second end of the upper chord of the third lattice panel are each provided with two laterally spaced portions with axially aligned lateral apertures, forming a female pin joint portion of the respective pin joint.

12. The lattice panel bridge section as claimed in claim 11 wherein the second end of the upper chord of the fourth lattice panel and the second end of the lower chord of the fourth lattice panel are each provided with a pin joint portion in the form of two laterally spaced portions with axially aligned lateral apertures.

13. The lattice panel bridge section as claimed in claim 12 wherein the second end of the lower chord of the second lattice panel is provided with a pin joint portion in the form of a spigot having a lateral aperture.

14. The lattice panel bridge section as claimed in claim 5, wherein the plate joint formed by the connected plates of the upper chords of the first and second lattice panels resists lateral displacement between the panels.

15. The lattice panel bridge section as claimed in claim 14, wherein the connected plates of the first and second lattice panels are each provided with at least one longitudinally facing aperture which receives a longitudinally extending fastener joining the plates together.

16. The lattice panel bridge section as claimed in claim 15, wherein each plate is provided with at least two vertically spaced apertures on either side of the upper chord, and a plurality of fasteners extend through the apertures in the plates and connect them together.

17. The lattice panel bridge section as claimed in claim 16, wherein the spacer has apertures through which the fasteners pass.

18. The lattice panel bridge section as claimed in claim 5, wherein the spacer is wedge shaped.

19. The lattice panel bridge section as claimed in claim 5, wherein a first reinforcing chord is attached to the upper chord of the first lattice panel, and a second reinforcing chord is attached to the upper chord of the second lattice panel, the first and second reinforcing chords having longitudinally facing end plates which are connected, the spacer between the connected facing plates of the upper chords of the first and second lattice panels also extending between the facing end plates of the reinforcing chords.

20. The lattice panel bridge section as claimed in claim 5, wherein a first reinforcing chord is attached to the upper chord of the first lattice panel, a second reinforcing chord is attached to the upper chord of the second lattice panel, the first and second reinforcing chords having longitudinally facing end plates which are connected, and an additional spacer is provided between the facing end plates of the reinforcing chords.

21. A lattice panel bridge incorporating a lattice panel bridge section as claimed in claim 5.

22. The lattice panel bridge as claimed in claim 21, wherein the tendency towards an upwardly directed camber is arranged to counteract sagging of the lattice bridge.

23. The lattice panel bridge as claimed in claim 21, wherein the tendency towards an upwardly directed camber is arranged to urge an upwardly directed camber in the lattice bridge.

24. A set of components for constructing a lattice panel bridge section, comprising:

first and second substantially rectangular prefabricated lattice panels, each lattice panel comprising a longitudinally extending upper chord, a longitudinally extending lower chord, and a plurality of web members interconnecting the upper and lower chords, wherein each lower chord is provided at each end with a pin joint portion having a transverse aperture and each upper chord is provided at each end with a longitudinally facing plate, each plate having a plurality of longitudinally directed apertures and the apertures of each plate being in corresponding positions;

a pin dimensioned and configured to pass through the transverse aperture of a pin joint portion of the first lattice panel and the transverse aperture of a pin joint portion of the second lattice panel, so as to form a pin joint between the lower chords of the first and second lattice panels;

a spacer dimensioned and configured to fit between a plate of the upper chord of the first lattice panel and a plate of the upper chord of the second lattice panel, the spacer having apertures in positions corresponding to those of the plates; and a plurality of fasteners, each fastener being dimensioned and configured to pass through an aperture in a plate of the upper chord of the first lattice panel, a corresponding aperture in the spacer, and a corresponding aperture in a plate of the upper chord of the second lattice panel, so as to connect the plates together with the spacer between the plates.

25. The set of components as claimed in claim 24, wherein:

a third lattice panel is provided including a longitudinally extending upper chord, a longitudinally extending lower chord, and a plurality of web members interconnecting the upper and lower chords;

the lower chord of the third lattice panel is provided at each end with a pin joint portion having a transverse aperture;

the upper chord of the third lattice panel is provided at one end with a longitudinally facing plate having a plurality of longitudinally directed apertures in positions corresponding to those in the plates of the upper chords of the first and second lattice panels;

the upper chord of the third lattice panel is provided at the other end with a pin joint portion having a transverse aperture;

a pin is dimensioned and configured to pass through the transverse aperture of the pin joint portion at one end of the lower chord of the third lattice panel and the transverse aperture of a pin joint portion of the first lattice panel, so as to form a pin joint between the lower chords of the first and third lattice panels; and a plurality of fasteners is provided, each fastener being dimensioned and configured to pass through an aperture in the plate of the upper chord of the third lattice panel and a corresponding aperture in a plate of the upper chord of the first lattice panel, so as to connect the plates together.

26. The set of components as claimed in claim 25, wherein:

a fourth lattice panel is provided including a longitudinally extending upper chord, a longitudinally extending lower chord, and a plurality of web members interconnecting the upper and lower chords;

the lower chord of the fourth lattice panel is provided at each end with a pin joint portion having a transverse aperture;

the upper chord of the fourth lattice panel is provided at each end with a pin joint portion having a transverse aperture;

a first pin is dimensioned and configured to pass through the transverse aperture of the pin joint portion at one end of the lower chord of the fourth lattice panel and the transverse aperture of a pin joint portion of the lower chord of the third lattice panel, so as to form a pin joint between the lower chords of the third and fourth lattice panels; and a second pin is dimensioned and configured to pass through the transverse aperture of the pin joint portion at one end of the upper chord of the fourth lattice panel and the transverse aperture of the pin joint portion of the upper chord of the third lattice panel, so as to form a pin joint between the upper chords of the third and fourth lattice panels.

27. A lattice panel bridge section comprising:

a first set of lattice panels joined in an end to end relationship, each lattice panel including a longitudinally extending upper chord, a longitudinally extending lower chord, and a plurality of web members interconnecting the upper and lower chords, adjacent lattice panels of the first set being joined together by transverse pin joints between their lower chords and by facing plates on their upper chords, the facing plates extending perpendicular to the longitudinal direction of the bridge;

a first transition lattice panel including a longitudinally extending upper chord, a longitudinally extending lower chord, and a plurality of web members interconnecting the upper and lower chords, one end of the first transition lattice panel being joined to a lattice panel at an end of the first set by a transverse pin joint between their lower chords and by facing plates on their upper chords, the facing plates extending perpendicular to the longitudinal direction of the bridge;

a second set of lattice panels joined in an end to end relationship, each lattice panel including a longitudinally extending upper chord, a longitudinally extending lower chord, and a plurality of web members interconnecting the upper and lower chords, adjacent lattice panels of the second set being joined together by transverse pin joints between their lower chords and by facing plates on their upper chords, the facing plates extending perpendicular to the longitudinal direction of the bridge; and a second transition lattice panel including a longitudinally extending upper chord, a longitudinally extending lower chord, and a plurality of web members interconnecting the upper and lower chords, one end of the second transition lattice panel being joined to a lattice panel at an end of the second set by a transverse pin joint between their lower chords and by facing plates on their upper chords, the facing plates extending perpendicular to the longitudinal direction of the bridge;

wherein the other end of the first transition lattice panel is connected to the other end of the second transition panel by means of a transverse pin joint between their upper chords and a transverse pin joint between their lower chords.

28. The lattice panel bridge section as claimed in claim 27, wherein the first and second transition panels are connected directly together.

29. The lattice panel bridge section as claimed in claim 27, wherein at least one intermediate lattice panel is provided between the first transition lattice panel and the second transition lattice panel, the intermediate lattice panel including a longitudinally extending upper chord, a longitudinally extending lower chord, and a plurality of web members interconnecting the upper and lower chords, there being a pin joint portion with a lateral aperture at each end of the upper chord and each end of the lower chord.

30. The lattice panel bridge section as claimed in claim 27, wherein at least some adjacent lattice panels of the first set and second set are connected with a spacer between the longitudinally facing plates.

31. A set of components for constructing a lattice panel bridge section, comprising:

a plurality of substantially rectangular main lattice panels, each main lattice panel including a longitudinally extending upper chord, a longitudinally extending lower chord, and a plurality of web members interconnecting the upper and lower chords, wherein each lower chord is provided at each end with a pin joint portion having a transverse aperture and each upper chord is provided at each end with a longitudinally facing plate, each plate having a plurality of longitudinally directed apertures and the apertures of each plate being in corresponding positions;

a pair of substantially rectangular transition lattice panels, each including a longitudinally extending upper chord, a longitudinally extending lower chord, and a plurality of web members interconnecting the upper and lower chords, the lower chord of each transition lattice panel being provided at each end with a pin joint portion having a transverse aperture, the upper chord of each transition lattice panel being provided at one end with a longitudinally facing plate having a plurality of longitudinally directed apertures in positions corresponding to those in the plates of the upper chords of the main lattice panels, and the upper chord of each transition lattice panel being provided at the other end with a pin joint portion having a transverse aperture;

a plurality of pins dimensioned and configured to pass through the transverse apertures of the main and transition lattice panels to form pin joints between the lower chords of adjacent lattice panels; and a plurality of fasteners dimensioned and configured to pass through the apertures in the plates of the main and transition lattice panels to connect the plates of adjacent lattice panels together.

32. The set of components as claimed in claim 31, further comprising at least one substantially rectangular intermediate lattice panel having a longitudinally extending upper chord, a longitudinally extending lower chord, and a plurality of web members interconnecting the upper and lower chords, the lower chord of the fourth lattice panel being provided at each end with a pin joint portion having a transverse aperture, and the upper chord of the intermediate lattice panel being provided at each end with a pin joint portion having a transverse aperture, the transverse apertures being dimensioned and configured to match the pins and the pin joint portions of the main and transition lattice panels.

33. The set of components as claimed in claim 31, further comprising a plurality of spacers dimensioned and configured to fit between the longitudinally facing plates of adjacent panels, the spacers having apertures corresponding to those in the plates.

34. A substantially rectangular prefabricated transition lattice panel for use in constructing a lattice panel bridge section, wherein the transition lattice panel comprises an upper chord, a lower chord, a plurality of web members interconnecting the upper and lower chords, and joint forming portions at each end of each chord, wherein:

at one end of the transition lattice panel the joint forming portion of the lower chord is in the form of a spigot having a transverse aperture, and the joint forming portion of the upper chord is in the form of a longitudinally facing plate with a plurality of longitudinally directed apertures; and at the other end of the transition lattice panel the joint forming portion of the upper chord and the joint forming portion of the lower chord both comprise two longitudinally extending, parallel spaced apart portions having transverse, axially aligned apertures.

35. A substantially rectangular prefabricated transition lattice panel for use in constructing a lattice panel bridge section, wherein the transition lattice panel comprises an upper chord, a lower chord, a plurality of web members interconnecting the upper and lower chords, and joint forming portions at each end of each chord, wherein:

at one end of the transition lattice panel the joint forming portion of the lower chord is in the form of two longitudinally extending, parallel spaced apart portions having transverse, axially aligned apertures, and the joint forming portion of the upper chord is in the form of a longitudinally facing plate with a plurality of longitudinally directed apertures; and at the other end of the transition lattice panel the joint forming portion of the upper chord and the joint forming portion of the lower chord both comprise a spigot having a transverse aperture.

36. A lattice panel bridge section comprising:

a first set of lattice panels joined in an end to end relationship, each lattice panel including a longitudinally extending upper chord, a longitudinally extending lower chord, and a plurality of web members interconnecting the upper and lower chords, adjacent lattice panels of the first set being joined together by pivot joints between their lower chords and by facing plates on their upper chords, the facing plates extending perpendicular to the longitudinal direction of the bridge;

a first transition lattice panel including a longitudinally extending upper chord, a longitudinally extending lower chord, and a plurality of web members interconnecting the upper and lower chords, one end of the first transition lattice panel being joined to a lattice panel at an end of the first set by a pivot joint between their lower chords and by facing plates on their upper chords, the facing plates extending perpendicular to the longitudinal direction of the bridge;

a second set of lattice panels joined in an end to end relationship, each lattice panel including a longitudinally extending upper chord, a longitudinally extending lower chord, and a plurality of web members interconnecting the upper and lower chords, adjacent lattice panels of the second set being joined together by pivot joints between their lower chords and by facing plates on their upper chords, the facing plates extending perpendicular to the longitudinal direction of the bridge; and a second transition lattice panel including a longitudinally extending upper chord, a longitudinally extending lower chord, and a plurality of web members interconnecting the upper and lower chords, one end of the second transition lattice panel being joined to a lattice panel at an end of the second set by a pivot joint between their lower chords and by facing plates on their upper chords, the facing plates extending perpendicular to the longitudinal direction of the bridge;

wherein the other end of the first transition lattice panel is connected to the other end of the second transition panel by means of a pivot joint between their upper chords and a pivot joint between their lower chords;

wherein the pivot joints include a transverse pin having an axis and passing through axially aligned transverse apertures defined on the respective lower chords.

* * * * *